US010730591B2

(12) United States Patent
Werner

(10) Patent No.: US 10,730,591 B2
(45) Date of Patent: Aug. 4, 2020

(54) MULTI-LOBE CARGO TANK

(71) Applicant: AC-INOX GmbH, Alsorf (DE)

(72) Inventor: Sascha Werner, Alsdorf (DE)

(73) Assignee: AC-INOX GMBH, Alsdorf (DE)

( * ) Notice: Subject to any disclaimer, the term of this patent is extended or adjusted under 35 U.S.C. 154(b) by 0 days.

(21) Appl. No.: 15/805,395

(22) Filed: Nov. 7, 2017

(65) Prior Publication Data

US 2018/0127064 A1 May 10, 2018

(30) Foreign Application Priority Data

Nov. 7, 2016 (EP) ..... 16197496

(51) Int. Cl.
*F17C 1/02* (2006.01)
*B63B 25/14* (2006.01)
(Continued)

(52) U.S. Cl.
CPC ..... *B63B 25/14* (2013.01); *F17C 1/002* (2013.01); *F17C 1/02* (2013.01);
(Continued)

(58) Field of Classification Search
CPC .... F17C 1/002; F17C 1/02; F17C 2201/0142; F17C 2201/0152; F17C 2201/0166; F17C 2209/221; F17C 2221/033; F17C 2260/01; F17C 2270/0105; F17C 2260/018; F17C 2223/0153; F17C 2203/0639; F17C 2205/0123; F17C 2205/0126; F17C 2205/013; F17C 2205/0134; F17C 2205/0138; F17C 2205/0142; F17C 2205/0146; F17C 2201/0171;
(Continued)

(56) References Cited

U.S. PATENT DOCUMENTS 2,533,431 A * 12/1950 Chausson ..... B64D 37/02 220/4.14
3,004,509 A 10/1961 Leroux
(Continued)

FOREIGN PATENT DOCUMENTS

CN 202046556 U 11/2011
CN 205203292 U 5/2016
(Continued)

OTHER PUBLICATIONS

Wheelhouse Hartmann Group News, May 2015, Issue 10, pp. 1 and 32.*
(Continued)

*Primary Examiner* — J. Gregory Pickett
*Assistant Examiner* — Niki M Eloshway
(74) *Attorney, Agent, or Firm* — Pillsbury Winthrop Shaw Pittman, LLP

(57) ABSTRACT

Multi-lobe tank for containing pressurized liquids, such as liquefied gas, for mounting into a ships hull, wherein the tank comprises at least a first longitudinally extending multi-lobe tank part having a center line and a second longitudinally extending multi-lobe tank part having a center line that are positioned behind each other resulting in a forward multi-lobe tank part and a rear multi-lobe tank part with aligned center lines, wherein the first part can tapered towards an end of the first part.

10 Claims, 5 Drawing Sheets

(51) Int. Cl.

| | |
|---|---|
| ***F17C 1/00*** | (2006.01) |
| *F17C 13/12* | (2006.01) |
| *B63B 25/08* | (2006.01) |

(52) U.S. Cl.

CPC . *B63B 2025/085* (2013.01); *F17C 2201/0142* (2013.01); *F17C 2201/0152* (2013.01); *F17C 2201/0166* (2013.01); *F17C 2203/013* (2013.01); *F17C 2209/221* (2013.01); *F17C 2221/033* (2013.01); *F17C 2260/01* (2013.01); *F17C 2270/0105* (2013.01)

(58) Field of Classification Search

CPC ... F17C 2203/01; F17C 2203/011–013; B63B 25/14; B63B 2025/085; B63B 3/68; B63B 25/16; B63B 27/25; B65D 25/14; B65D 83/38; Y10S 220/29

USPC .... 220/4.14, 23.8, 23.83, 23.2, 581; 206/0.6

See application file for complete search history.

(56) References Cited

U.S. PATENT DOCUMENTS

| | | | | | |
|---|---|---|---|---|---|
| 3,083,669 | A | | 4/1963 | Bunn et al. | |
| 3,092,063 | A | | 6/1963 | Leroux | |
| 3,645,415 | A | * | 2/1972 | Phelps | B65D 88/06 137/259 |
| 4,182,254 | A | * | 1/1980 | Secord | B63B 25/08 114/74 A |
| 4,615,452 | A | * | 10/1986 | Lederer | B65D 88/04 220/501 |
| 4,946,056 | A | | 8/1990 | Stannard | |
| 6,095,367 | A | | 8/2000 | Blair et al. | |
| 6,223,929 | B1 | * | 5/2001 | Gerhard | F17C 1/02 220/565 |
| 6,494,405 | B1 | | 12/2002 | Kirn et al. | |
| 7,093,337 | B1 | | 8/2006 | Taylor | |
| 2007/0194051 | A1 | * | 8/2007 | Bakken | F17C 1/08 222/173 |

FOREIGN PATENT DOCUMENTS

| | | | | | |
|---|---|---|---|---|---|
| DE | 1103168 | B | | 3/1961 | |
| EP | 1945498 | B1 | * | 11/2006 | B63B 3/68 |
| EP | 1945498 | A2 | * | 7/2008 | B63B 3/68 |
| EP | 3056792 | A2 | * | 8/2016 | F17C 1/00 |
| EP | 3056792 | A2 | * | 8/2016 | F17C 1/00 |
| FR | 1037900 | A | | 9/1953 | |
| FR | 1114057 | A | | 4/1956 | |
| FR | 1334894 | A | | 8/1963 | |
| HU | 74193 | T | * | 4/1995 | E21B 34/00 |
| JP | 57-172892 | A | | 10/1982 | |
| JP | 58-45500 | U | | 3/1983 | |
| JP | 7-69277 | A | | 3/1995 | |
| JP | 2009-517272 | A | | 4/2009 | |
| JP | 2012-132537 | A | | 7/2012 | |
| WO | 84/01553 | | | 4/1984 | |
| WO | 2007/062770 | A2 | | 6/2007 | |
| WO | 2015/041542 | A1 | | 3/2015 | |

OTHER PUBLICATIONS

Wheelhouse Hartmann Group News, May 2015, Issue 10, pp. 1 and 32. (Year: 2015).*

Wheelhouse Hartmann Group News Date Findings (Year: 2018).*

Extended European Search Report dated Apr. 21, 2017 issued in corresponding European Patent Application No. 16197496.9.

Bjorn Munko, "New Generation of Modern LNG Carriers with Type C Cargo Tanks and LNG Propulsion System", TGE Marine Gas Engineering, Gastech London, 2012, 30 pages.

Article entitled "Hartmann Unveils Eco-Friendly Ethylene Carrier", MarineLog, 2 pages http://www.on4ckz.be/NAVAL/HARTMANN%20UNVEILS%20ECO.pdf.

Michael Kraack, "LNG Aufbereitung und Tank Systeme", Marine Service GmbH, Oct. 8, 2014, 45 pages.

G.V. Wan Tassel, "LNG as a Vessel and General Transportation Fuel Developing the Required Supply Infrastructure", Society of Naval Architects and Marine Engineers, 2010 Annual Meeting, Bellevue, Washington, 13 pages.

Craig Eason, "Aronnax: Cutting the Innovation Path", Lloyd's List, Aug. 20, 2014, 3 pages.

"Ships for transatlantic ethane", Royal Belgian Institute of Marine Engineers, LPG Supplement 2014, 2 pages.

"VIII Rules for Construction of Pressure Vessels Division 1", 2013 ASME Boiler & Pressure Vessel Code an International Code, 2013 Edition, Jul. 1, 2013, The American Society of Mechanical Engineers, 768 pgs.

Notification of the First Office Action dated Oct. 29, 2019 issued in corresponding Chinese Patent Application No. 201711083575.4 with English translation (15 pages).

Notification of Reasons for Refusal dated Dec. 17, 2019 issued in corresponding Japanese Patent Application No. 2017-214786 with English translation (8 pages).

Notice of Non-Final Rejection dated Jan. 21, 2020 issued in corresponding Korean Patent Application No. 10-2017-0147389 with English translation (11 pages).

* cited by examiner

MULTI-LOBE CARGO TANK

CROSS-REFERENCE TO RELATED APPLICATIONS

This application claims priority to European Patent Application No. 16197496.9, filed Nov. 7, 2016, the contents of which is incorporated herein by reference in its entirety.

FIELD OF THE INVENTION

The invention relates to a multi-lobe cargo tank for containing pressurized liquids, such as liquefied gas.

BACKGROUND TO THE INVENTION

Multi-lobe tanks are well known and often used for storage and/or transportation in particular of liquefied gases. Such tanks are mounted on ships or other naval vessels to transport liquefied gases. Also, these tanks can be mounted onshore to store liquefied gases on certain locations. Typically, multi-lobe tanks are provided on ships in a lying or horizontal position, whereas an onshore multi-lobe tank is usually in a standing or vertical position.

A drawback of these multi-lobe tanks, in particular when mounted on vessels, is that the center of gravity of the tank, and thus the center of gravity of the vessel becomes relatively high, which negatively affects the stability of the vessel. This may limit the performance of the vessel, e.g. in terms of transit speed or in terms of maximal cargo. Solutions are known to lower the multi-lobe tank with respect to the ship's hull, but this negatively affects the shape of the ship's hull which also may have negative effects on stability and/or transit speed for example.

Therefore, there is a need to transport liquefied gases with vessels in a way that at least partly obviates at least one of the above mentioned drawbacks.

SUMMARY OF THE INVENTION

Thereto, the invention provides for a multi-lobe tank containing pressurized liquids, such as liquefied gas, for mounting into a ships hull, wherein the tank comprises at least first longitudinally extending multi-lobe tank part having a center axis and a second longitudinally extending multi-lobe tank part having a center axis that are positioned behind each other resulting in a forward multi-lobe tank part and a rear multi-lobe tank part with aligned center axes, wherein the first part is tapered towards an end of the first part. By providing a forward and a rear tank part that are joined to each other at a connection side, of which one part is tapered, the shape of the multi-lobe tank may fit better in a ship's hull. In particular, the tapered part may fit well in a bow side of the hull. As such, the tank can be mounted lower into the ship's hull resulting in a lower center of gravity of the vessel. Thereby, the stability of the vessel may increase, which may result in improved performance of the ship. Also, due to the lower positioning of the tank, the multi-lobe tank may become larger allowing for a larger cargo load.

Advantageously, the first tank part and the second tank part are approximately equally long, such that both tank parts form about half of the length of the tank. Thus, the tank may better fit into the ship's hull. In an alternative embodiment, the tapered tank part may occupy a different part of the axial length of the total axial length of the tank, e.g. a third or a fourth partition may be possible, also more than half may also be possible, e.g. two thirds of the length. In another embodiment, a third tank part having a center axis may also be provided and which may be positioned in line with the other tank part such that the central axes are aligned. The third tank part may be positioned behind the second tank part such that the second tank part becomes intermediate to the first and third tank part. In a further embodiment, the third tank part may also be tapered. It is to be understood that the axial distribution of the first tank part and the second tank part may vary and may depend on the design of the ship's hull. Also, it is to be understood that the presence of a possible third tank part may depend on the design of the ship's hull and/or that the axial distribution of the first, second and third tank part may vary and may depend on design requirements.

In a preferred embodiment, the first tank part and the second tank part are manufactured separately, each having an open end where they can be joined together and having a closed end opposite thereto. The first tank part and the second tank part are then joined together at their open ends. At an opposite side of the open ends, the first and second tank parts have closed ends. The tank parts are then joined at their open ends to form a multi-lobe tank. The first tank part can be tapered towards its closed end, such that the diameter and/or cross-sectional area at the open end of the first tank part is larger than the diameter and/or cross-sectional area at or near the closed end of the first tank part, thus, in an embodiment, conically tapering towards the closed end. Preferably, at or near the connection between the first tank part and the second tank part, a transverse web is provided. Thus, additional stiffness of the tank is provided. Also, sloshing of the liquefied gas between the first and the second part is reduced. The transverse web is advantageously provided with holes to allow motion of the liquid between the first tank part and the second tank part while preferably avoiding critical sloshing.

In a preferred embodiment, the multi-lobe tank is configured as a tri-lobe tank having two bottom lobes and a top lobe. This is an advantageous configuration lowering the center of gravity of the filled tank. Alternatively, the multi-lobe tank can be configured as a quad-lobe tank having two bottom lobes and two top lobes.

Advantageously, in the tri-lobe tank, a Y-configuration longitudinal reinforcing web is provided to strengthen the tank in longitudinal direction and/or in a direction transverse to the longitudinal direction, i.e. in a cross-sectional plane. The Y-shaped reinforcing web connects the outer shells of adjacent lobes. Advantageously, the Y-shaped reinforcing web is provided with openings and/or holes to allow equipment to be lowered from a top of the tank to the bottom and to be retracted from the bottom towards the top. Preferably, the said openings and/or holes also provide for guidance of the equipment through the opening and/or hole. In particular, equipment such as a pump may have to be lowered to the bottom of the tank to empty the tank from cargo. Advantageously, such a pump is located at the lowest positions of the tank, which are typically at the bottom of the bottom lobes. When providing guide holes in the oblique arms of the Y-shaped longitudinal web, equipment can be lowered and/or retracted there through.

Advantageously, the tank is supported onto saddle supports, and more advantageously at least one of the saddle supports is a sliding support. By providing a sliding support, movement of the tank, such as expansion or shrinkage due to the temperature changes of the liquefied gas in the tank, can be accommodated. In an advantageous embodiment, the sliding support comprises wooden blocks that are movable with respect to each other. Typically, wood has an advantageous strength-isolation ratio, meaning that wood can withstand relatively high loads, e.g. compression loads, and provide reasonable or advantageous isolation. Preferably, the contact surfaces of the wooden blocks are provided with a metal sheet to reduce wearing and to provide for metal-to-metal contact during the sliding movement between the metal sheets of the wooden blocks. Also, by using wood, the thermal conduction between the tank and its environment, such as a ship's hull can be reduced, as at the positions of the supports, the isolation of the tank is interrupted. This may improve the thermal isolation of the tank and thus reduce energy consumption to cool the tank.

The connections between nodes of the three lobes and the Y-shaped longitudinal reinforcing web are provided as Y-joints. This is contrary to prior art connections in which the three structures that are joined together, the shell of one lobe, the shell of another lobe and a leg of the Y-shaped longitudinal reinforcing web, are welded together. In view of the high stresses at this weld, due to thermal forces, due to cryogenic temperature and/or ship's acceleration, this weld is extremely critical and therefore usually very heavy. By now providing a dedicated Y-joint that fits onto the node, the single bulgy weld can be replaced by three welds in less critical areas. There are then a welding seam to connect the Y-joint to one shell of one lobe, a seam to connect the Y-joint to the shell of the other lobe and a seam to connect the Y-joint to the longitudinal Y-shaped reinforcing web. This is particularly advantageous, because the Y-joint can now be manufactured in a controlled environment and dedicated to the expected loads. Also, welding the Y-joint to the construction is more simple and straightforward than welding a complex joint where three structures join. This significantly improves reliability of the constructions as well as decreases the manufacturing and/or maintenance costs.

In an advantageous configuration, the distance between the center axes of the bottom lobes of a tri-lobe tank is double of the distance that the center axis of the top lobe is there above. In a more advantageous configuration are all distances between the center axes of the three lobes approximately equal. Thus, the configuration of the tri-lobe tank may be optimized for lowering the center of gravity of a filled tank in view of the available space in a ship's hull.

Further advantageous embodiments are represented in the subclaims.

The invention will further be elucidated on the basis of exemplary embodiments which are represented in a drawing. The exemplary embodiments are given by way of non-limitative illustration.

In the drawing:

FIG. 1 shows a general arrangement of a multi-lobe tank according to the invention in a vessel;

FIG. 2*a* shows a forward view of an embodiment of a multi-lobe tank, in particular a tri-lobe tank;

FIG. 2*b* shows a side view of the embodiment of FIG. 2*a;*

FIG. 2*c* shows a top view of the embodiment of FIG. 2*a;*

Figure 2A:
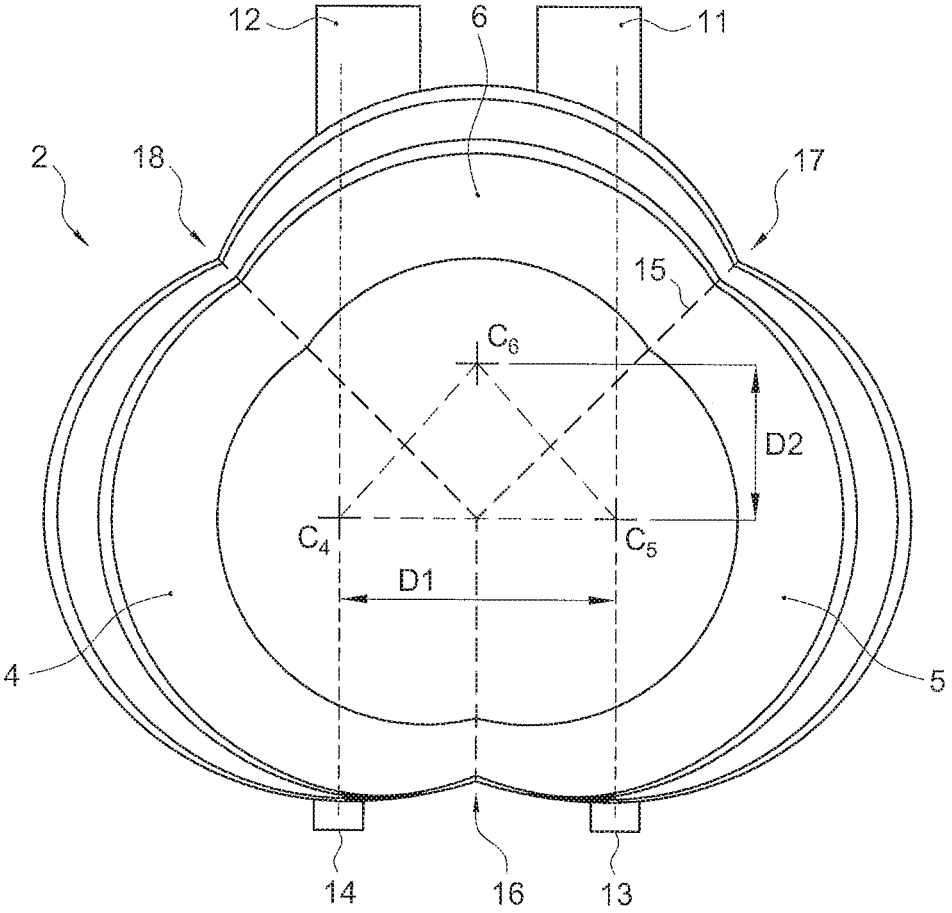
Figure 2B:
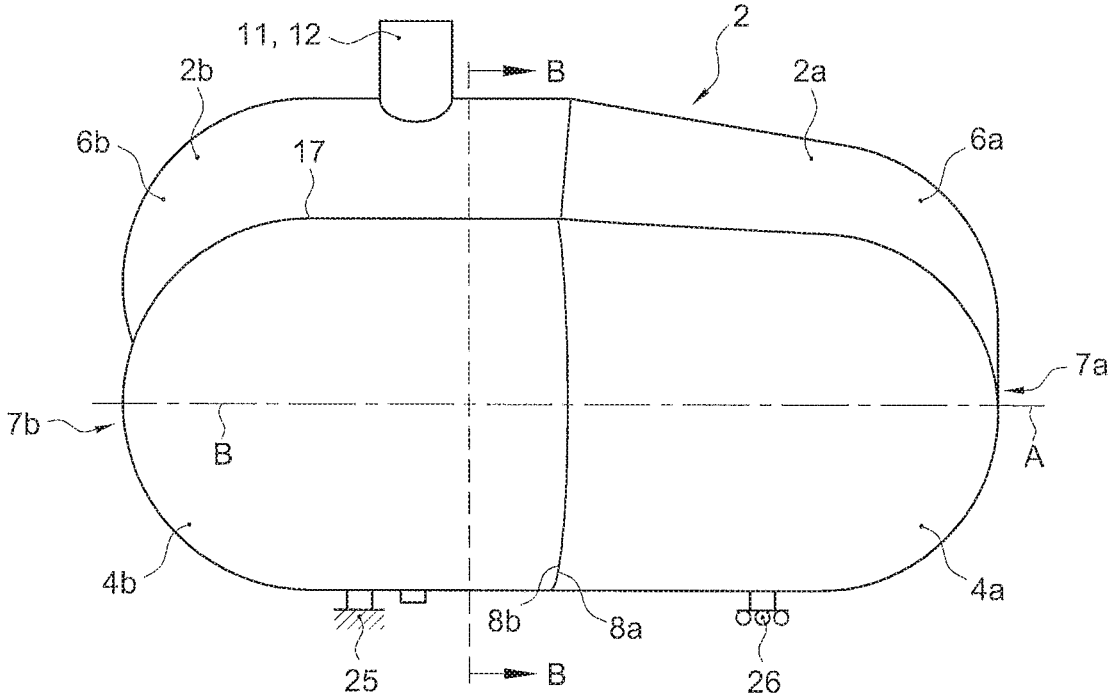
Figure 6:
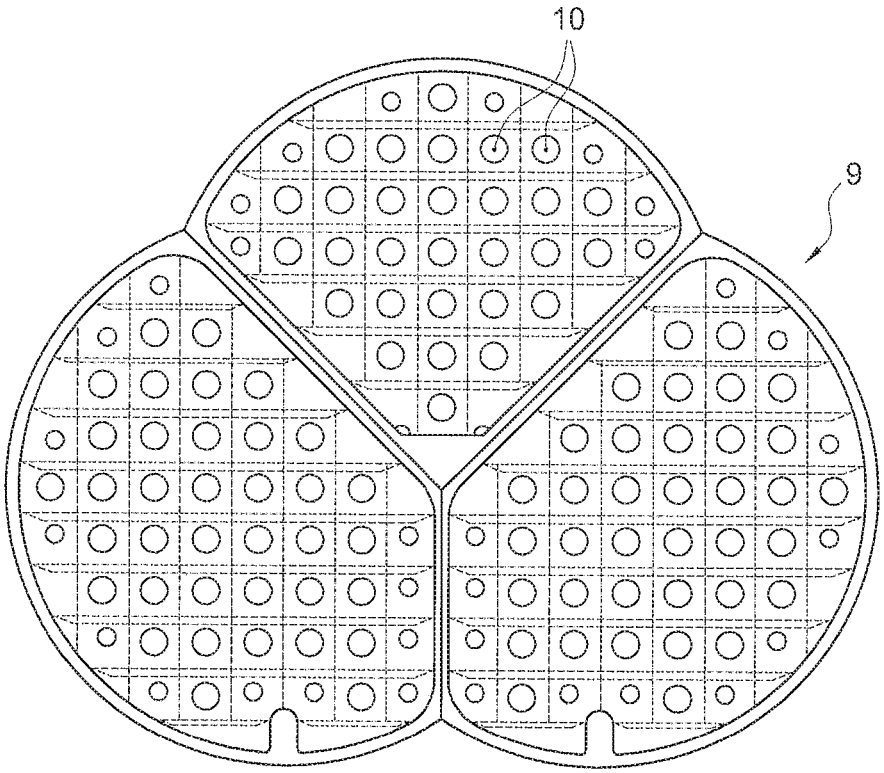
Figure 7B:
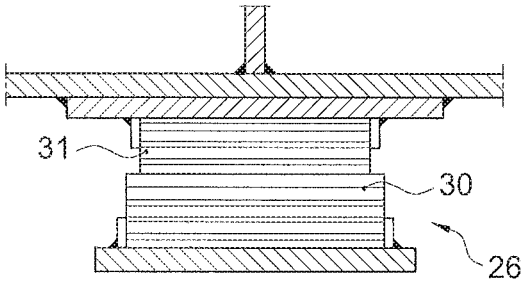
Figure 7A:
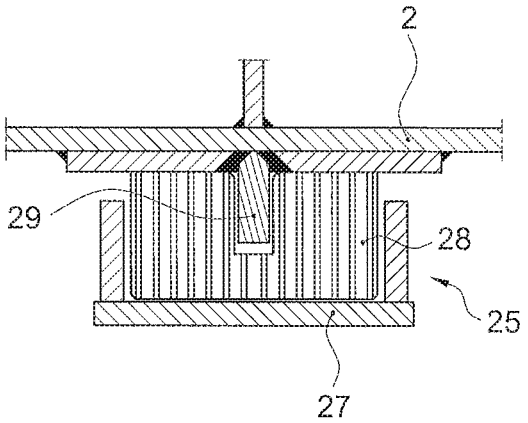
Figure 8:
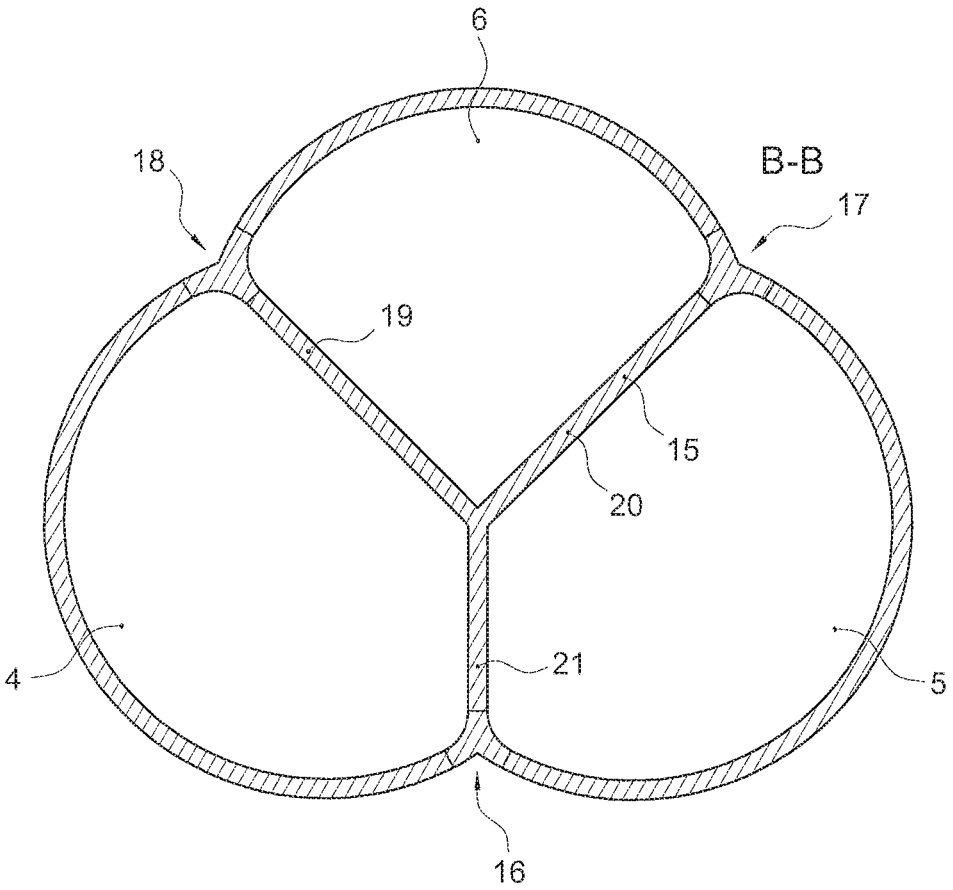

FIG. 6 gives a schematic representation of the transverse web between the first tank part and the second tank part;

FIG. 7*a* gives a schematic cross-section of a fixed support;

FIG. 7*b* gives a schematic cross-section of a sliding support;

FIG. 8 a cross-sectional view of the embodiment of FIG. 2*b* at section B-B.

It is noted that the figures are only schematic representations of embodiments of the invention that are given by way of non-limiting example. In the figures, the same or corresponding parts are designated with the same reference numerals.

Figure 1:
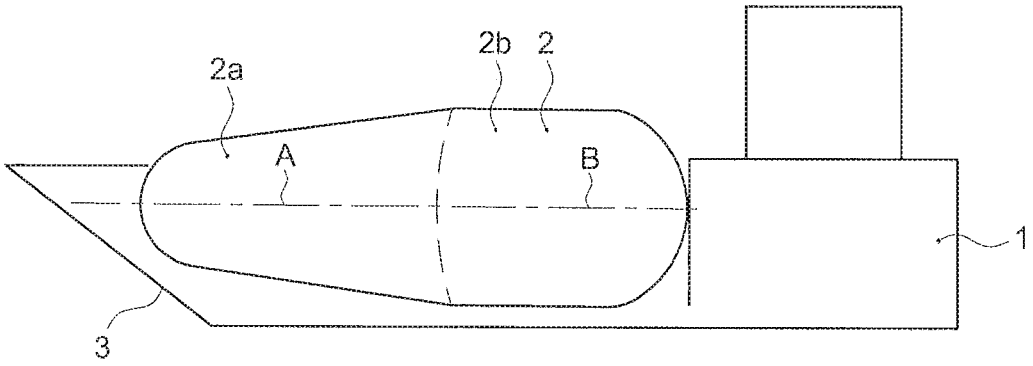

FIG. 1 shows a schematic representation of a general arrangement of a vessel 1 with a multi-lobe tank 2 according to the invention. In this embodiment, the multi-lobe tank is shown mounted in the hull of the vessel or the ship. In other embodiments, the multi-lobe tank can be positioned onshore for storage of liquefied gas.

The multi-lobe tank 2 is mounted in a lying position in the ship's hull, in an onshore configuration, the multi-lobe tank 2 typically would be mounted in a standing position.

The multi-lobe tank 2 comprises a first longitudinally extending multi-lobe tank part 2*a* and a second longitudinally extending multi-lobe tank part 2*b*. Each tank part 2*a*, 2*b* has a central axis A, B. The first tank part 2*a* and the second tank part 2*b* are positioned behind each other resulting in a forward tank part, here tank part 2*a*, and a rear tank part, here tank part 2*b*, of which the central axes A, B are aligned. The tank parts 2*a*, 2*b* are thus coincident with each other. According to the invention, the first tank part 2*a* is tapered towards an end thereof. Here, the first tank part 2*a* is the forward tank part when seen in the sailing direction of the vessel.

By tapering the first tank part 2*a*, it fits better in the forward part of the ship comprising the bow 3 of the ship. As such, the tank 2 can be mounted lower in the cargo space of the hull of the ship 1, which may reduce the height of the center of gravity and thus may increase the stability of the ship.

Figure 2C:
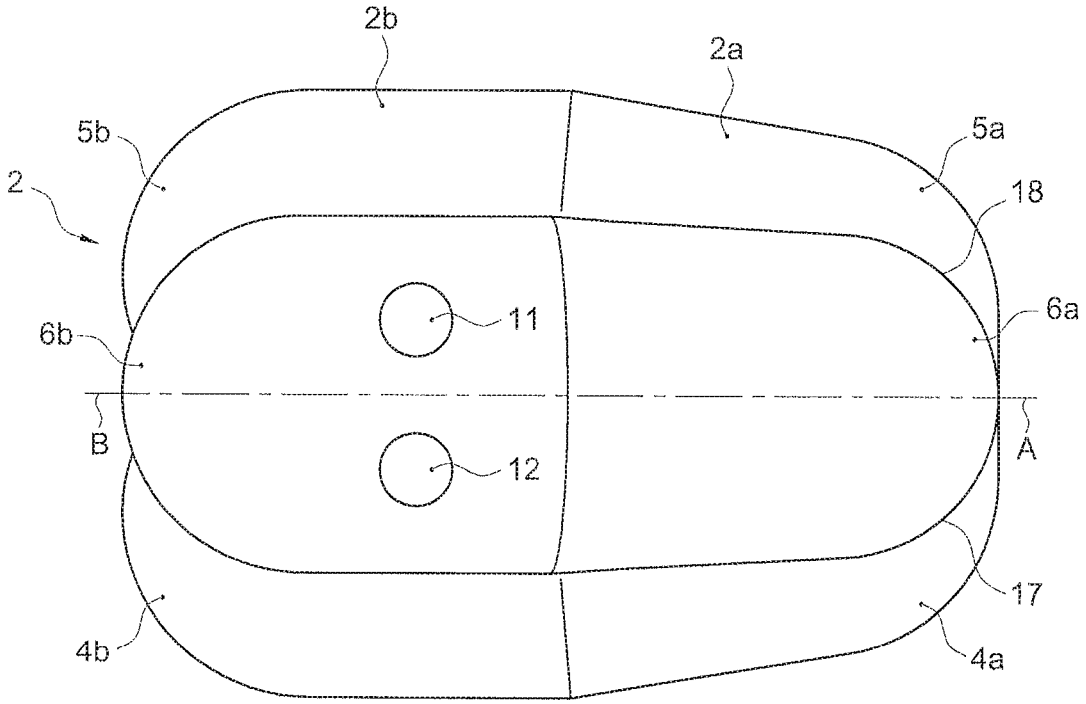

FIG. 2*a* shows schematically a front view of a multi-lobe tank 2. Here, in this embodiment, the multi-lobe tank 2 is a tri-lobe tank having two bottom lobes 4, 5 and a top lobe 6. FIG. 2*b* shows schematically a side view of the tri-lobe tank 2, and FIG. 2*c* shows schematically a top view. Each tank part 2*a*, 2*b* has two bottom lobes 4*a*, 5*a*, 4*b*, 5*b* respectively and one top lobe 6*a*, 6*b* respectively. As can be seen in the figures, the central axes A, B of the respective first tank part 2*a* and the second tank part 2*b* are in line with each other. Each tank part 2*a*, 2*b* has a closed end 7*a*, 7*b* and has an open end 8*a*, 8*b*. At the open ends 8*a*, 8*b* the tank parts 2*a*, 2*b* are joined to each other, usually by means of welding. Thus, the tank parts 2*a*, 2*b* can be manufactured separately from each other, and later be joined together to form the tank 2. This may improve the production time. Preferably, at the joining connection of the first part 2*a* and the second part 2*b*, a transverse web 9 is provided. The transverse web 9 is inside of the tank 2 and for example shown in FIG. 6. The transverse web 9 provides for reinforcement of the tank 2 and is preferably provided with holes 10 to allow liquid to move between the first tank part 2*a* and the second tank part 2*b*.

In the embodiment of FIGS. 2*a*, 2*b*, 2*c*, the tank 2 comprises two tank parts 2*a*, 2*b* which are approximately equally long. This may be advantageous in terms of manufacturing and installation into the cargo space of the ship's hull. Also, it may be advantageous to fit better into the ship's hull. However, other embodiments can be thought of wherein the first tank part can be larger or shorter than the second tank part, for example depending on a specific hull shape. Also, in another embodiment, the tank 2 may comprise more than two tank parts, for example, a forward tank part, a rear tank part and an intermediate tank part. In a further embodiment, instead of tri-lobe tank, a quad-lobe tank may be considered or a bi-lobe tank. Many variants are possible.

Figure 3:
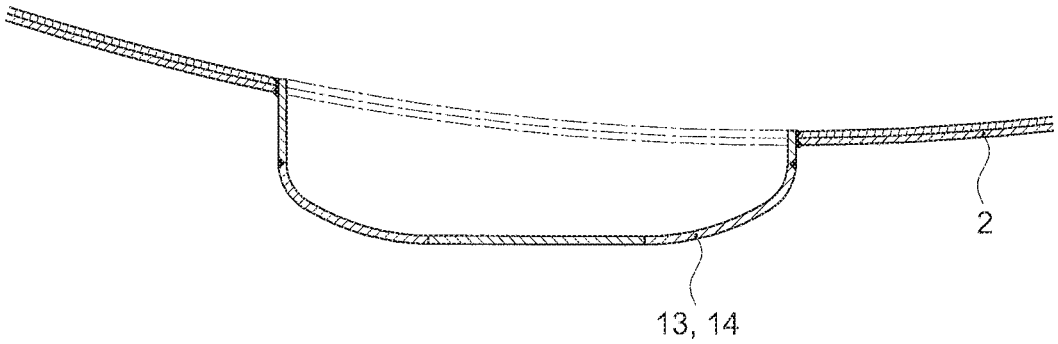
FIG. 3 shows a detail of a sump in a bottom of a lobe of the multi-lobe tank.

As can be seen in the FIGS. 2*a*, 2*b*, 2*c*, on top of the tank two entrances 11, 12 are provided. Via these entrances, typically e.g. a man hole, equipment such as pumps, or, when necessary, workmen can enter into the inside of the tank, for example for maintenance and/or repair, or for emptying and/or cleaning of the tank. Each entrance 11, 12 is positioned above the lowest position of the respective lobes 4, 5. Entrance opening 11 is positioned above a lowest position of lobe 5, and entrance opening 12 is positioned above a lowest position of lobe 4. This in particular advantageous when lowering a pump for emptying the tank. Then, the pumps can be lowered to the lowest position and then emptying the tank 2. In an advantageous embodiment, at the lowest position, a pump receiving recess 13, 14 can be provided. In these recesses, 13, 14, the pumps can be positioned. Then, upon pumping, they can also remove almost all last remaining liquid from the tank. FIG. 3 gives a schematical cross-sectional detail of an embodiment of the recess 13, 14.

As can be seen in for example FIG. 2*a*, the multi-lobe tank is here a trilobe tank having two bottom lobes 4, 5 and a top lobe 6. Each lobe 4, 5, 6 has its own centerline C4, C5 and C6 respectively. The top lobe 6 is positioned above the bottom lobes 4, 5 such that the distance D1 between the centerlines C4, C5 of the bottom lobes 4, 5 is approximately double the distance D2 that the centerline C6 is above the centerlines C4, C5. As such, the center of gravity of the trilobe tank 2 can remain relatively low, while the volume of the tank 2 can be optimal, which is advantageous in optimizing carried load, i.e. the liquefied gas to be transported.

Further, the trilobe tank 2 is provided with a reinforcing web 15. The reinforcing web 15 is a longitudinal web, in the front view of FIG. 2*a* it can be seen schematically. A cross-section is shown in FIG. 8. The Y-configuration longitudinal reinforcing web 15 extends between the nodes of the lobes in a Y-shape configuration. The three lobes 4, 5, 6 form three nodes 16, 17, 18 respectively where the lobes intersect. In a top view, bottom view or a side view, these nodes 16, 17, 18 form lines where the lobes 4, 5, 6 intersect. The Y-configuration reinforcing web 15 (FIG. 8/4) has three web-legs, two oblique webs 19, 20 and a standing web 21. Advantageously, the transverse web 9 comprises three parts wherein each part fits between web-legs of the Y-configuration reinforcing web 15 at the location of the transverse web 9.

Figure 4:
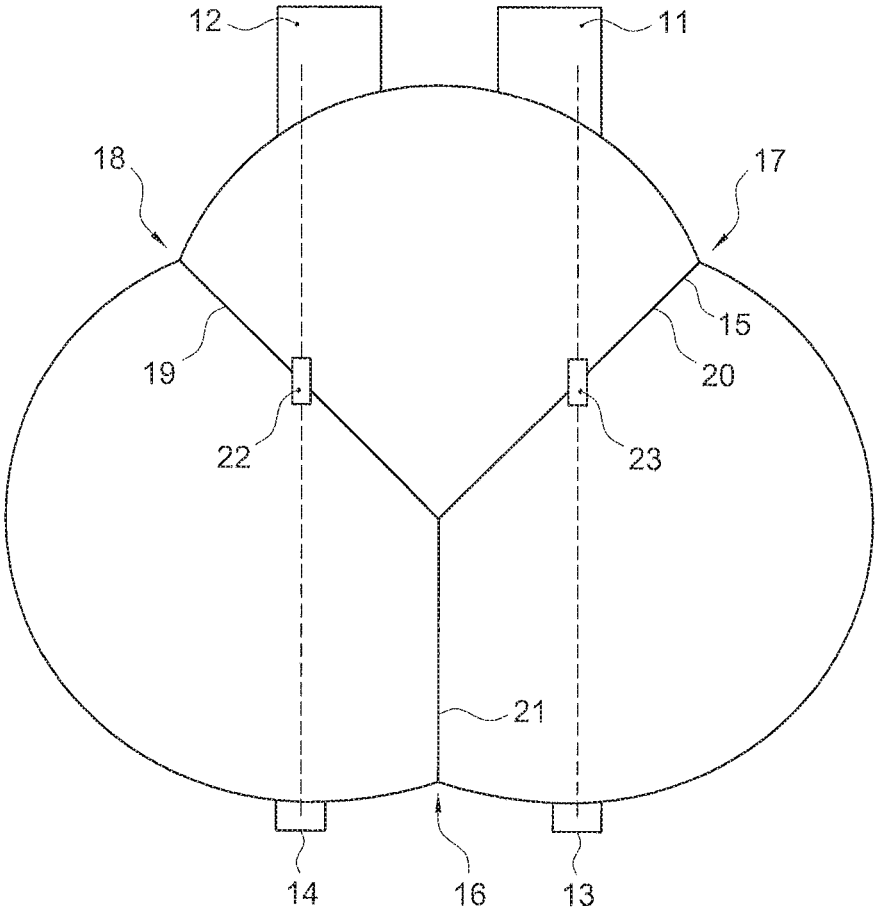
FIG. 4 shows a schematic cross-sectional view of the multi-lobe tank, in particular a tri-lobe tank, at the position of the guide openings in the Y-shaped longitudinal reinforcing web.

The Y-configuration reinforcing web 15 has a plate-like structure, each web-leg 19, 20, 21 of the Y-configuration is of a plate-like structure. These plate-like structures are provided with holes to allow liquid to pass through between the different lobe-compartments (FIG. 4).

At certain positions in the oblique webs 19, 20 guide openings 22, 23 are provided to allow equipment being lowered and/or retracted therethrough. In particular, the guide openings 22, 23 are provided at a position approximately corresponding with the position of the openings 11, 12 and the recesses 13, 14, such that equipment being entered into the tank via the openings 11, 12 can be guided through the reinforcing web 15 via the guide openings 22, 23 towards the recesses 13, 14. In some embodiments these openings 11, 12 and guide openings 22, 23 can be sufficiently large to allow a man to pass through, i.e. the openings have minimal "man-hole"-size. Then, workmen can enter the tank for reparation, inspection, maintenance etc. In an advantageous embodiment, the guide openings 22, 23 have upwardly extending walls as to guide the equipment therethrough. The upwardly extending walls may be cylindrical or tubular with various cross-sections possible, e.g. circular, square, triangular. At an upper end and/or a lower end of the guide walls, outwardly flaring flanges may be provided to further guide the equipment towards the guide opening.

Figure 5:
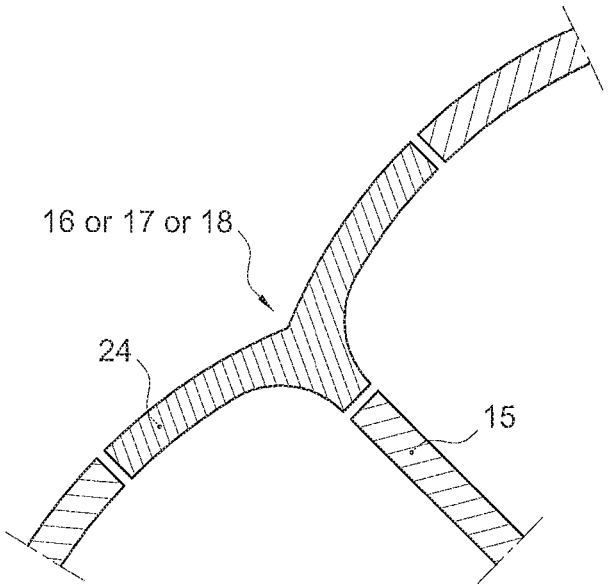
FIG. 5 shows a detail of a Y-joint to connect lobes to the Y-shaped reinforcing web.

Advantageously, the Y-configuration reinforcing web 15 is connected to the lobes 4, 5, 6 at the nodes 16, 17, 18 by means of a Y-joint 24, as can be seen in FIG. 5. By providing this Y-joint 24, complex welding operations can be omitted and the Y-joint 24 can be manufactured dedicated with respect to the forces it may be subject to. As such, the Y-joint 24, typically a forging piece, but other manufacturing methods are also possible, can be manufactured in a controlled environment, e.g. a fabrication hall and can be thoroughly inspected and controlled prior to be joined with the lobe walls and the reinforcing web. This improves the reliability and/or strength of the joint at the nodes.

The tank 2 is supported by means of a fixed support 25 and a sliding support 26 to allow movement of the tank 2 due to temperature variations, loads, etc. The fixed support 25 preferably is a saddle support, an embodiment of which is shown in FIG. 7*a*. The fixed support 25 comprises lower part or a holder 27 fixedly mounted to an external structure—the fixed world—e.g. a bottom of the cargo space of the vessel in which the tank is to be placed. Further, the support 25 comprises an upper part 28, or block of material 28, that is fixedly mounted to the tank 2. The block of material 28 is received in the lower part or holder 27 and preferably can withstand relatively high forces, e.g. wood, or a rubber-like material, or a composite material. The block of material 28 is itself fixedly mounted to the tank 2. Here, a protrusion 29 is welded to the tank wall that is inserted into the block material 28. The block material can have any shape, depending on the shape of the holder 27. As such, the interruption of the isolation of the outer wall of the tank 2 can be limited and sufficient support can be provided.

The sliding support 26 comprises a first part, or lower part, 30 that is fixedly mounted to the fixed world, and a second part or upper part 31. For the sliding support, the upper part 31 is slidingly engaged with the lower part 30. Advantageously, the upper part 31 and the lower part 30 are configured as wooden blocks. More advantageously, at the engagement surfaces of the upper part 31 and the lower part 30 a metal sheet or metal layer is provided, such that metal-on-metal or metal-on-wood contact is provided for the slidingly engaged blocks. As such, a reliable sliding connection can be obtained, while minimizing the interruption of the thermal isolation material of the tank 2, and thus reducing the thermal bridge across the support. In particular by using wooden blocks, for the sliding support 26 and/or for the fixed support 25, the thermal bridges may be reduced and thermal isolation of the tank 2 may remain effective, despite the interruption by the supports 25, 26.

For the purpose of clarity and a concise description features are described herein as part of the same or separate embodiments, however, it will be appreciated that the scope of the invention may include embodiments having combinations of all or some of the features described. It may be understood that the embodiments shown have the same or similar components, apart from where they are described as being different.

For example, in the figures the embodiment is explained by means of a trilobe tank, but all aspects described are equally well applicable to a quadlobe tank or a even a higher multi-lobe tank, e.g. a five-lobe tank. Also, all aspects are equally well applicable when the tank would be in an upwardly standing position, as it would be the case on a stationary location, such as onshore.

Many variants will be apparent to the person skilled in the art. All variants are understood to be comprised within the scope of the invention defined in the following claims.

The invention claimed is:

1. A multi-lobe tank for containing pressurized liquids tbr mounting into a ship's hull, wherein the multi-lobe tank comprises at least a first longitudinally extending multi-lobe tank part having a center line extending centrally and in longitudinal direction of the first longitudinally extending multi-lobe tank part and a second longitudinally extending multi-lobe tank part having a center line extending centrally and in longitudinal direction of the second longitudinally extending multi-lobe tank part, the second longitudinally extending multi-lobe tank part being positioned behind the first longitudinally extending multi-lobe tank part resulting in a forward multi-lobe tank part and a rear multi-lobe tank part with aligned center lines, wherein the forward multi-lobe tank part and rear multi-lobe tank part are joined to each other at a connection, wherein the forward multi-lobe tank part has a tank wall that is tapered constantly from the connection towards a closed end of the forward multi-lobe tank part that is opposite to an end at the connection with the rear multi-lobe tank part such that a cross-sectional area at the connection of the forward multi-lobe tank part and rear multi-lobe tank part is larger than a cross-sectional area at or near the closed end of the forward multi-lobe tank part, and further comprising a transverse web inside the multi-lobe tank and provided at the connection between the forward multi-lobe tank part and the rear multi-lobe tank part, wherein the transverse web is plate structure that extends over the entire larger cross-sectional area in a direction transverse to the longitudinal direction of the multi-lobe tank.

2. The multi-lobe tank according to claim 1, wherein the first tank part and the second tank part are approximately equally long.

3. The multi-lobe tank according to claim 1, wherein the multi-lobe tank is a tri-lobe tank having two bottom lobes and one top lobe positioned above the bottom lobes, each of the bottom and top lobes comprising first and second tank parts and having the center lines.

4. The multi-lobe tank according to claim 3, further comprising a Y-configuration longitudinal reinforcing web provided at connections between nodes of the lobes.

5. The multi-lobe tank according to claim 4, wherein the Y-configuration longitudinal reinforcing web has oblique webs, and Wherein guide openings are provided in the oblique webs to allow equipment being lowered and/or retracted to be guided therethrough.

6. The multi-lobe tank according to claim 4, wherein at nodes between lobes and/or the reinforcement web a Y-joint is provided to connect the Y-configuration longitudinal reinforcing web and lobes.

7. The multi-lobe tank according to claim 4, wherein the transverse web comprises three parts and wherein each of the three parts is positioned between legs of the Y-configuration longitudinal reinforcing web at the location of the transverse web.

8. The multi-lobe tank according to claim 3, wherein a distance between the center lines of the bottom lobes is approximately double a distance or height that the center line of the top lobe is positioned above the center lines of the bottom lobes.

9. The multi-lobe tank according to claim 1, further comprising saddle supports to support the multi-lobe tank, wherein at least one of the saddle supports is a sliding support.

10. The multi-lobe tank according to claim 9, wherein the sliding support comprises sliding wooden blocks.

* * * * *